US007021470B2

(12) United States Patent
Bennett et al.

(10) Patent No.: US 7,021,470 B2
(45) Date of Patent: Apr. 4, 2006

(54) ORIENTATION DEVICE AND METHODS FOR MAIL PROCESSING

(75) Inventors: Bruce A. Bennett, Omaha, NE (US); Ron Prchal, Plattsmouth, NE (US)

(73) Assignee: First Data Corporation, Englewood, CO (US)

( * ) Notice: Subject to any disclaimer, the term of this patent is extended or adjusted under 35 U.S.C. 154(b) by 211 days.

(21) Appl. No.: 10/675,928

(22) Filed: Sep. 29, 2003

(65) Prior Publication Data

US 2005/0067762 A1 Mar. 31, 2005

(51) Int. Cl.
*B07C 5/00* (2006.01)

(52) U.S. Cl. ..... 209/509; 271/186

(58) Field of Classification Search ..... 209/509, 209/900, 584; 271/184, 185, 186
See application file for complete search history.

(56) References Cited

U.S. PATENT DOCUMENTS

| | | | | |
|---|---|---|---|---|
| 2,362,134 | A | | 11/1944 | Honig |
| 3,717,337 | A | | 2/1973 | McCain et al. |
| 4,060,228 | A | | 11/1977 | Tress et al. |
| 4,511,132 | A | | 4/1985 | Muller |
| 4,527,793 | A | | 7/1985 | Bottcher et al. |
| 4,577,848 | A | | 3/1986 | Hams |
| 4,634,107 | A | | 1/1987 | Vandersyde et al. |
| 4,697,246 | A | | 9/1987 | Zemke et al. |
| 4,718,657 | A | | 1/1988 | Otter et al. |
| 4,753,430 | A | | 6/1988 | Rowe et al. |
| 5,082,268 | A | | 1/1992 | Santoro |
| 5,088,711 | A | | 2/1992 | Newsome |
| 5,171,005 | A | | 12/1992 | Manley et al. |
| 5,327,701 | A | | 7/1994 | Dronsfield |
| 5,388,815 | A | * | 2/1995 | Hill et al. ..... 270/32 |
| 5,460,273 | A | * | 10/1995 | Stevens et al. ..... 209/584 |
| 5,464,099 | A | * | 11/1995 | Stevens et al. ..... 209/3.1 |
| 5,647,583 | A | | 7/1997 | Emigh et al. |
| 5,722,221 | A | | 3/1998 | Maltman et al. |
| 5,896,725 | A | | 4/1999 | Lundstrom et al. |
| 5,926,392 | A | * | 7/1999 | York et al. ..... 700/223 |
| 6,094,894 | A | | 8/2000 | Yates |
| 6,135,292 | A | | 10/2000 | Pettner |
| 6,164,043 | A | | 12/2000 | Miller et al. |
| 6,202,005 | B1 | | 3/2001 | Mahaffey |
| 6,267,366 | B1 | | 7/2001 | Graushar et al. |
| 6,670,569 | B1 | | 12/2003 | Smith et al. |
| 2003/0088552 | A1 | | 5/2003 | Bennett et al. |

* cited by examiner

*Primary Examiner*—Kenneth Noland
(74) *Attorney, Agent, or Firm*—Townsend and Townsend and Crew LLP

(57) ABSTRACT

A mail processing device includes a reorientation arrangement that, when the mail processing device is in a first position, is configured to sequentially receive mail items from an upstream process and reorient each item such that the top side of a particular item from the upstream process becomes the bottom side of the item when placed in a downstream process. The device also includes a receiving arrangement configured to receive mail items from the upstream process and guide the mail items into the reorientation arrangement. The device also includes a controller that is programmed to cause the reorientation arrangement to reorient a mail item in response to the detection of the mail item by a sensor. The controller is further programmed to cause the mail item to be moved toward the downstream process after each mail item is reoriented.

12 Claims, 6 Drawing Sheets

126
124
202
T
206
203
209
201
208
216
204
T
128
210
205
204
212
218
214

126
124
T
202
206
203
209
201
208
216
204
B
128
205
210
204
212
218
214

126
124
202
206
T
201
203
302
T
T
304
205
128
214

ORIENTATION DEVICE AND METHODS FOR MAIL PROCESSING

CROSS-REFERENCES TO RELATED APPLICATIONS

This application is related to co-pending, commonly assigned U.S. patent application Ser. No. 10/036,653, entitled "MAIL HANDLING EQUIPMENT AND METHODS," filed on Nov. 8, 2001, and to co-pending, commonly assigned U.S. patent application Ser. No. 10/045,589, entitled "SYSTEM & METHODS OF PROVIDING INSERTS INTO ENVELOPES," filed on Nov. 8, 2001, the complete disclosures of which are incorporated herein by reference for all purposes.

BACKGROUND OF THE INVENTION

This invention relates generally to the field of mail processing, and in particular to the processing of mail relating to financial institutions. More specifically, the invention relates to devices for properly orienting mail items so that they may be placed into an envelope for mailing to a recipient.

Credit cards play an important role in today's economy. To receive a credit card, a person typically fills out an application which is processed by a bank that will issue the card. If the application is approved, the card needs to be produced and sent to the requester. Banks often contract another company to produce and issue cards on their behalf. For example, one such company is First Data Resources (FDR).

To issue a card, the bank sends the information to FDR, typically in electronic form. Using this information a card is embossed and initialized with the appropriate information. The card is then attached to a paper carrier and then placed into an envelope for mailing. Existing equipment for performing such steps are commercially available from Bowe, Augsberg, Germany. Optionally, a second sheet and one or more inserts may also be added prior to placement into the envelope.

Unfortunately, such equipment can be expensive, typically on the order of about $1 million. As such, this invention relates to other machines and techniques that may be used to process such media in a more cost efficient manner.

BRIEF SUMMARY OF THE INVENTION

Embodiments of the invention thus provide a mail processing device. The device includes a reorientation arrangement that, when the mail processing device is in a first position, is configured to sequentially receive mail items from an upstream process and reorient each item such that the top side of a particular item from the upstream process becomes the bottom side of the item when placed in a downstream process. The device also includes a receiving arrangement configured to receive mail items from the upstream process and guide the mail items into the reorientation arrangement. The device also includes a controller that is programmed to cause the reorientation arrangement to reorient a mail item in response to the detection of the mail item by a sensor. The controller is further programmed to cause the mail item to be moved toward the downstream process after each mail item is reoriented.

In some embodiments, the mail processing device may include a guide arrangement that, when the mail processing device is in a second position, is configured to receive the mail items from the upstream process and guide each mail item to the down stream process without reorienting each item with respect to its top and bottom sides. The mail processing device may include a sensor that senses whether the mail processing device is in the first position or the second position. The reorientation arrangement may include a bin that receives each mail item, an axle that defines an axis about which the bin is configured to rotate, and a motor configured to rotate the bin approximately 180° about the axis by driving the axle. The bin may include a first container and a second container that are arranged generally symmetrical with respect to one another about the axle such that the first container is disposed above the second container when the first container is positioned to receive a mail item, and the first container is disposed below the second container when the first container is positioned to deposit a mail item onto a conveyor configured to transport the mail item toward the downstream process, thereby positioning the second container to receive a subsequent mail item. The mail processing device may include a guard having an open position and a closed position. When the guard is in the closed position it generally restricts access to moving parts of the reorientation arrangement. The device may include a sensor that senses the position of the guard and prevents operation of the reorientation arrangement when the guard is open and the mail processing device is in the first position. The mail items may include a card carrier and a card attached thereto. The mail items may be z-folded documents folded along two folds that divide the document into three roughly equal areas. The mail items may include documents folded twice in half width-wise, along folds that divide the document into four roughly equal areas.

In other embodiments, a method of processing mail items includes sequentially receiving mail items at a mail processing device from an upstream process, reorienting each mail item such that the top side of each item in the upstream process becomes the bottom side of the item in a downstream process, and sequentially advancing each mail item to the downstream process. The mail items may be a card carrier and a card attached thereto. The mail items may be z-folded documents such that two folds divide the document into three roughly equal areas. The mail items may be documents folded twice in half width-wise, thus positioning folds that divide the document into four roughly equal areas.

In still other embodiments, a mail processing device includes means for sequentially receiving mail items from an upstream process, means for reorienting each item such that the top side of each item in the upstream process becomes the bottom side of the item in a downstream process, and means for sequentially advancing each mail item to the downstream process. The mail items may be a card carrier and a card attached thereto. The mail items may be z-folded documents such that two folds divide the document into three roughly equal areas. The mail items may be documents folded twice in half width-wise, thus positioning folds that divide the document into four roughly equal areas. The mail processing device may include means for guiding each mail item from the upstream process to the down stream process without reorienting each item with respect to its top and bottom sides. The means for reorienting each item may include a bin that receives each mail item, an axle that defines an axis about which the bin is configured to rotate, and a motor configured to rotate the bin approximately 180° about the axis by driving the axle.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

The present invention relates to a mail orientation device. In one embodiment, the present invention provides a device that receives mail from an upstream process and invents it before advancing it to a down stream process. The mail item may be any of a number of items, including credit card carriers with a credit card attached, a credit card carrier without a credit card attached, a letter, a statement, an insert, or the like, or any combination of the foregoing. The item may be folded one or multiple times.

This embodiment of the invention is particularly useful for reorienting mail items in an automated process. For example, if a card carrier with an attached card includes an address label that must show through a window in an envelope, the card carrier must be properly oriented when inserted into the envelope. If the upstream process improperly orients the items with respect to the downstream process, then each item must be reoriented. In many cases, this problem would not be solved by simply reversing the orientation of a large number of such items stacked together. In order to maintain the items in a proper sequence, each item must be reoriented individually. Thus, in this embodiment, the present invention receives each item, reorients it, and passes it to the downstream process while maintaining the items in a proper sequence.

In another embodiment, the present invention includes two positions, a reorientation position and a non-reorientation position. In many cases, automated mail processing equipment must be reconfigured quickly to minimize the down time of the production process. In such processing environments, it often is the case that some batches require the items to be reoriented within the process, while other batches do not. This embodiment of the present invention allows consecutive batches having different such requirements to be sequentially processed with little down time between batches. Because this embodiment of the invention has two positions, the device may be quickly reconfigured, thus increasing throughput.

Figure 1:
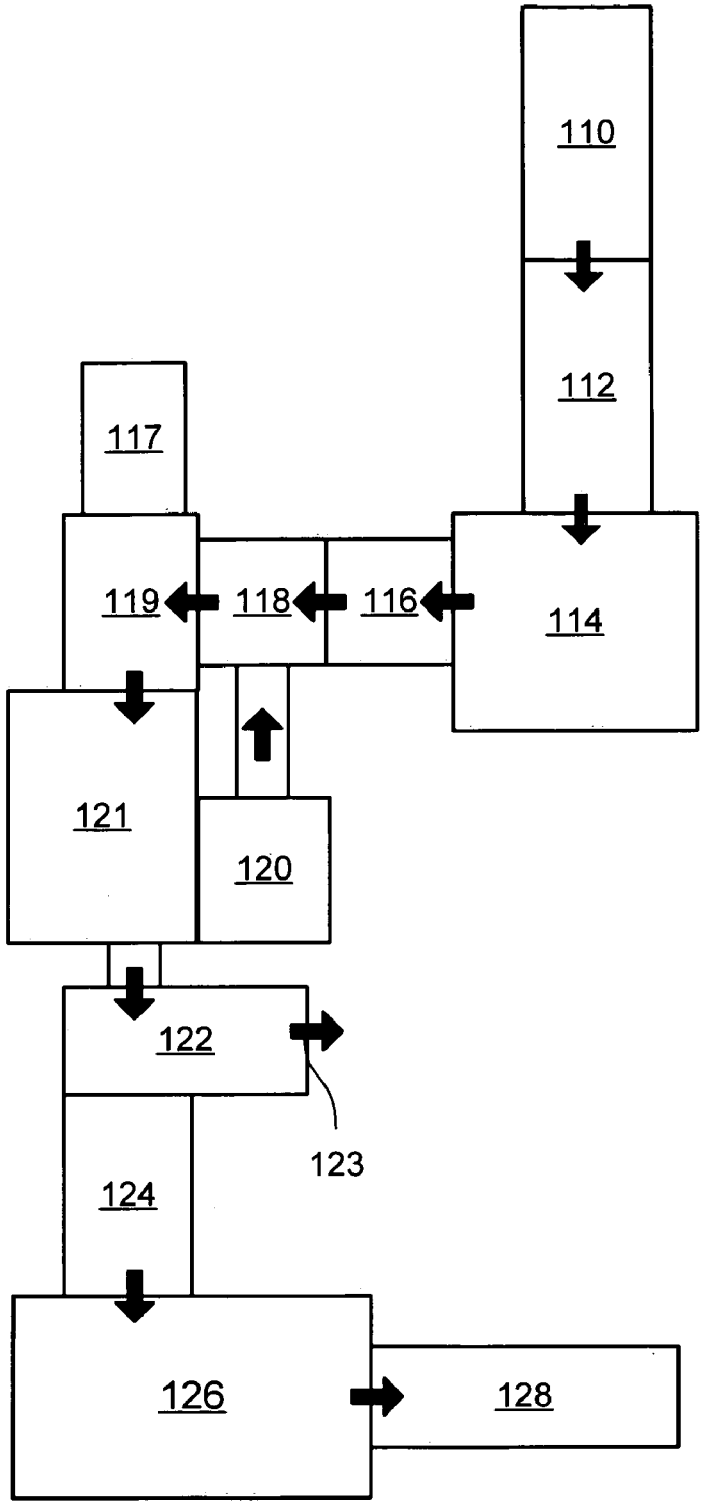
FIG. 1 depicts a simplified schematic of a mail processing system according to an embodiment of the present invention.

Having described embodiments of the invention generally, attention is directed to FIG. 1, which depicts a simplified schematic of a mail processing system 100 according to embodiments of the present invention. System 100 includes a series of stations adapted to produce folded mail items oriented in a specific orientation. The mail items may include cards affixed to card carriers. Cards processed by system 100 can include credit cards, debit cards, company and stored-value cards, smart cards, phone cards, and the like. Documents processed by system 100 may include a customer billing statement, a new cardholder agreement, a renewal card statement, a card carrier, and the like. Documents also may include a paper insert, such as an advertisement or the like.

In the embodiment shown in FIG. 1, system 100 includes a printer 110 adapted to print alpha numeric characters on a statement, a sheet of paper, a card carrier, or the like. Printer 100 prints information such as an account number, a customer name and mailing address, a monetary account limit, and the like, and further may print one or more bar codes. In one embodiment, at least one of the bar codes identifies inserts, from a plurality of different inserts, to be sent to a customer.

The printed statements or card carriers (not shown) travel down a belt 112 and are stacked in a stacking unit 114. Further details on stacking unit 114 are discussed in previously-incorporated U.S. patent application Ser. No. 10/045,589, which in one embodiment also operates to at least partially fold the statement or card carrier. The sheets are then sequentially drawn from stacking unit 114 into unit 116.

In one embodiment, unit 116 includes a bar code reader for reading a bar code or other identification mark on the statement or card carrier. The bar code may, for example, identify inserts to be later matched up with the card carrier. In another embodiment, unit 116 also reads a number, such as a three digit number, associated with the card carrier to facilitate proper matching with a card having a corresponding number.

In one embodiment, the carrier is transferred from unit 116 into unit 118. A card is received from unit 120 and matched with the corresponding card carrier in unit 118. In some embodiments, the card is glued, placed in slots or otherwise affixed to the card carrier in unit 118. Additional details on unit 120 are described in previously-incorporated U.S. patent application Ser. No. 10/045,589. The mated card carrier and card are transferred to unit 119. If a processing error has occurred, unit 119 deflects the card and card carrier into a bypass tray or receiving area 117. Processing errors may include, for example, mismatched cards and card carriers, and the like. If no error has occurred, unit 119 deflects the card and card carrier into a folding unit 121.

Folding unit 121 performs a fold of the statement or card carrier. In one embodiment, folding unit 121 performs a second fold of the card carrier, resulting in a card carrier that is approximately the size of a business class envelope. In a particular embodiment, the first and second folds of the card carrier produce a Z-fold card carrier. In other embodiments, the first and second folds of the card carrier produce a chevron-folded card carrier (i.e., a carrier that is twice folded in half width-wise). Folding unit 121 further includes a card detection assembly, which operates to detect if the card is missing or if too many cards have been placed in the card carrier. In one embodiment, the card detection assembly tests a thickness of the card carrier to determine if the appropriate number of cards are contained in the card carrier.

If the card detection assembly indicates an error, such as too many cards or a missing card(s), the card carrier is transferred to a bypass tray or receiving area in the direction shown by arrow 123. If no errors occur, then the card carrier is transferred via conveyor 124 to orientation device 126.

Orientation device 126, as will be explained in more detail hereinafter, operates to properly orient items for further processing. In some embodiments, this involves flipping each item so that the top portion upon entering the orientation device 126 becomes the bottom portion upon exiting the orientation device. In other embodiments, this involves leaving the orientation of each item unchanged.

After passing through orientation device 126, the items are transported down conveyor 128. In some embodiments, system 100 may include additional units to which the items would be transported by conveyor 128. Such processing is explained more fully in previously-incorporated U.S. patent application Ser. No. 10/045,589. In other embodiments, system 100 operates to affix cards to card carriers, but is not used for processing further inserts. In this embodiment, the card carriers and cards are passed down conveyor 128, and removed from system 100. The card carriers may then, if desired, be transported to an envelope stuffing apparatus, a mail room or the like. In other embodiments, the cards and carriers proceed through further automated processing.

It should be apparent to those skilled in the art that, while the system 100 has been described with reference to card carriers and cards, this is not a requirement. Other mail items may be processed using the device and methods disclosed herein. Further, embodiments of the invention do not necessarily include all the units herein described. Other mail processing systems according to embodiments of the invention may include more, fewer, or even different units that those described here.

Figure 2A:
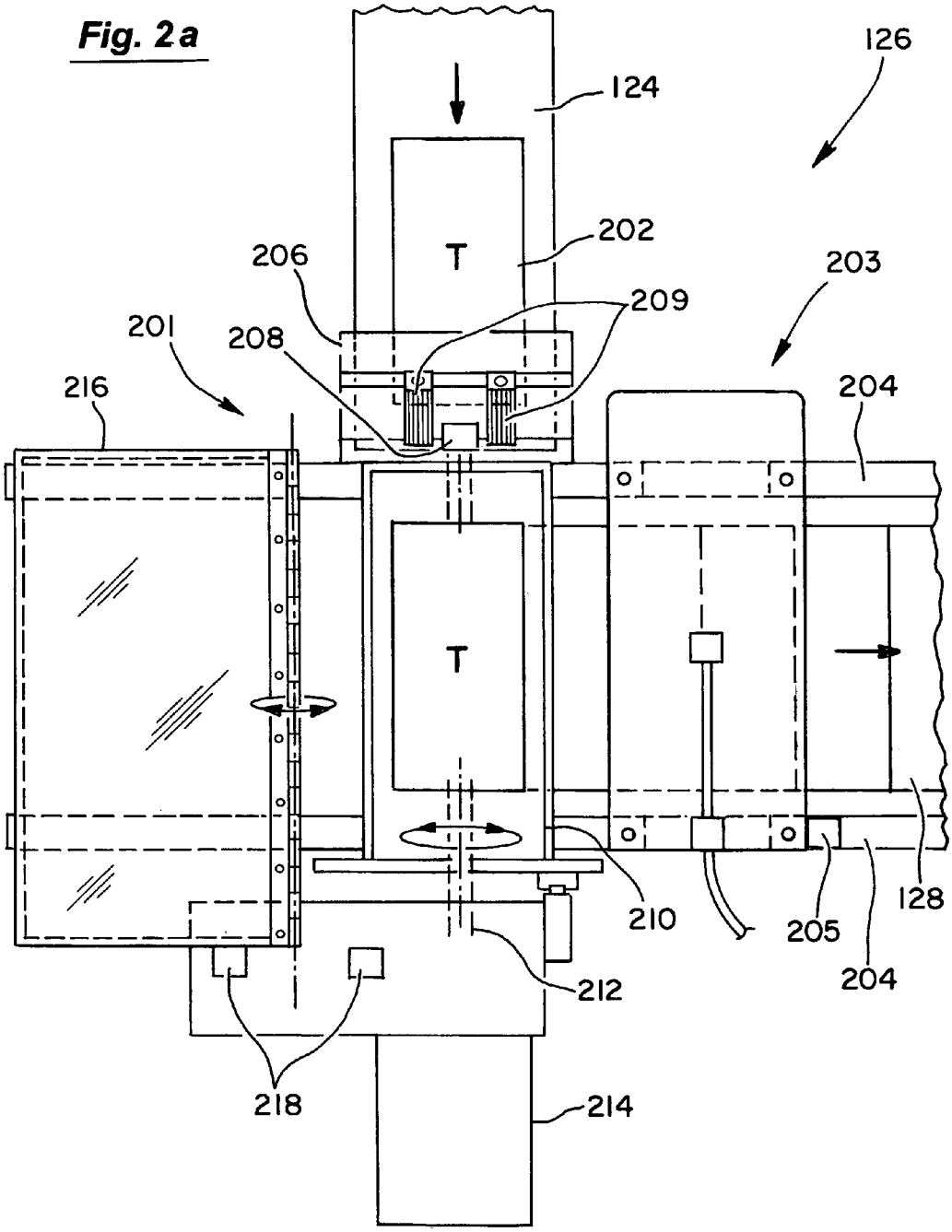
FIGS. 2A–2C illustrate a mail orientation device in a reorientation position according to embodiments of the invention.
Figure 2B:
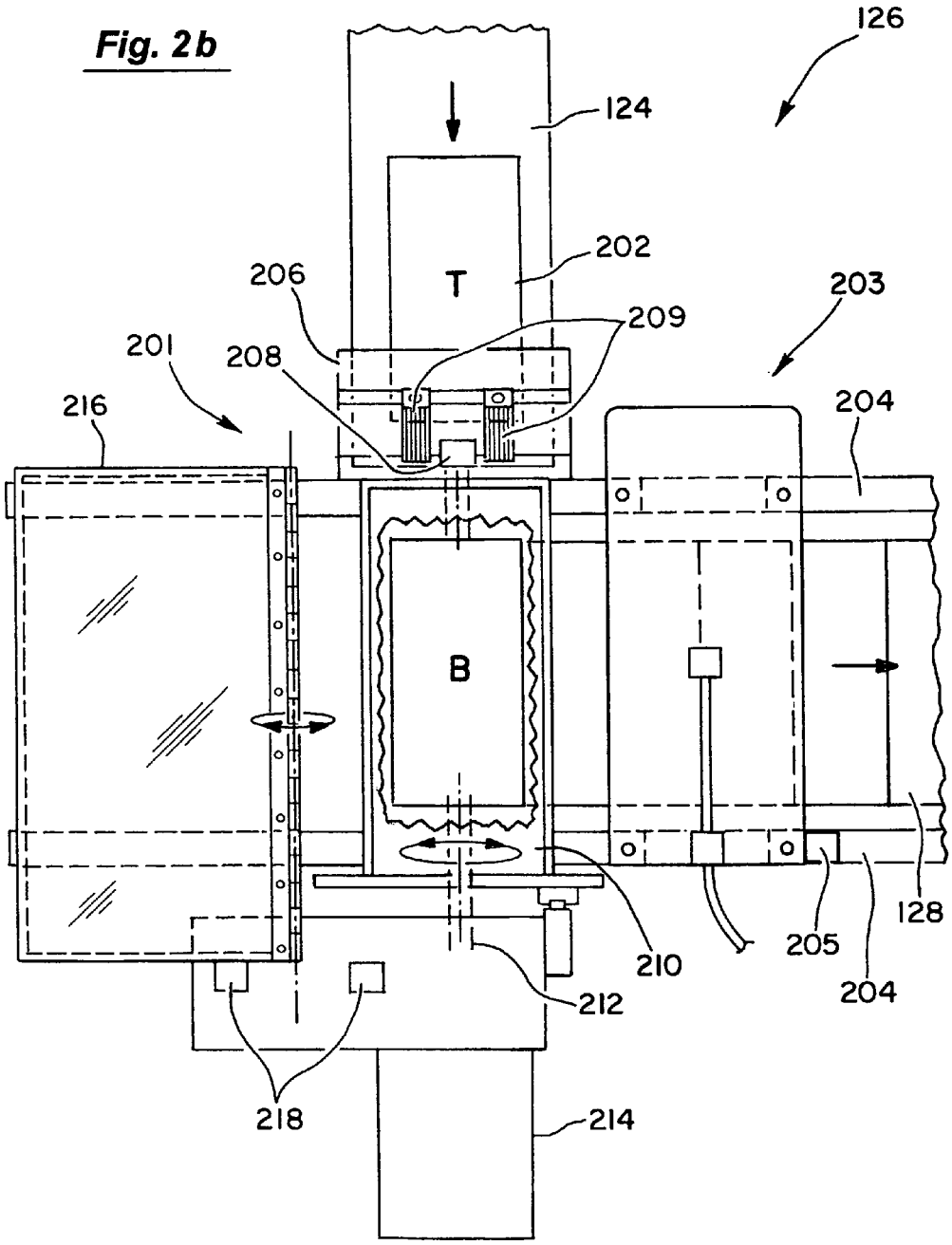
Figure 2C:
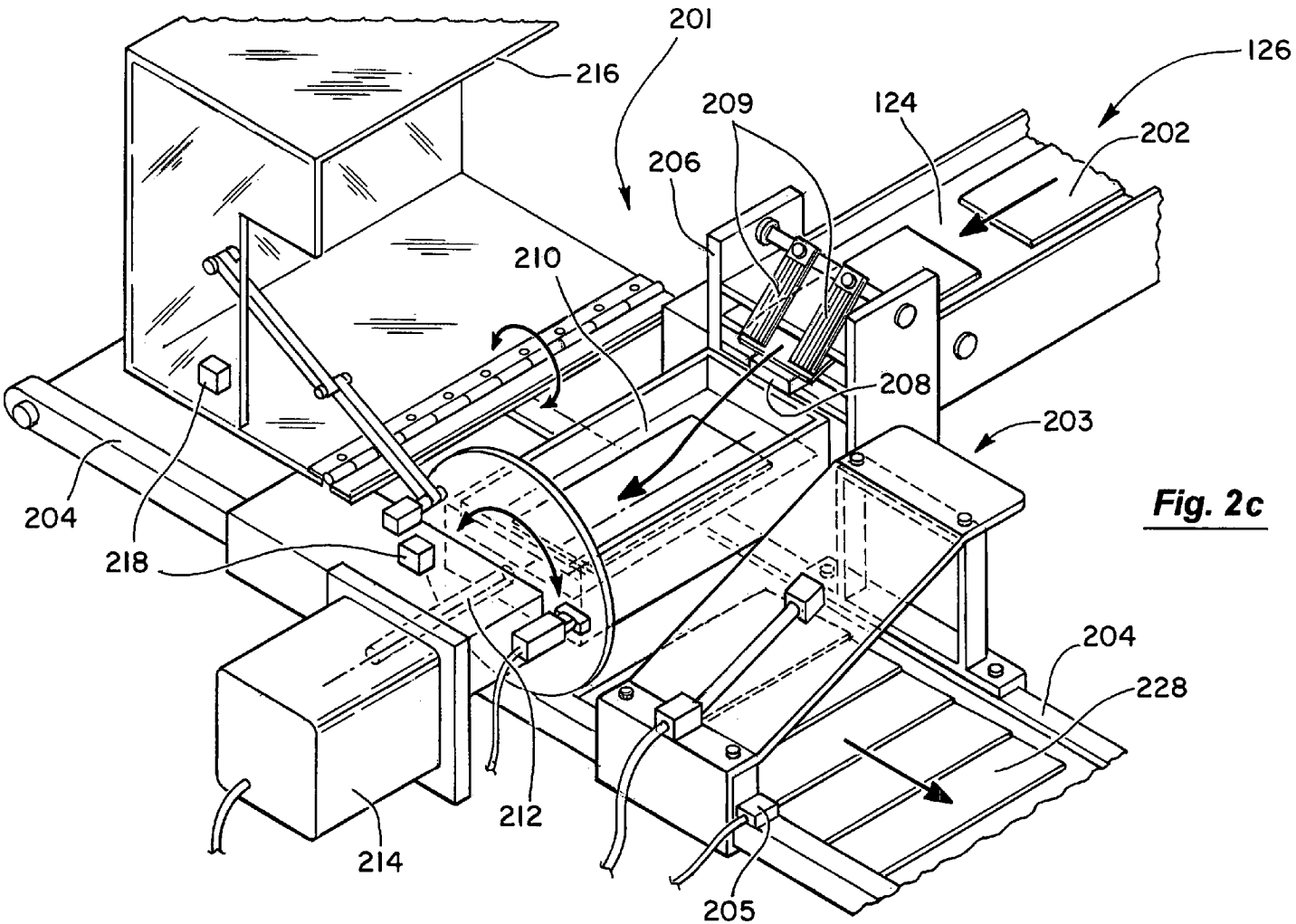

Attention is directed to FIGS. 2A and 2B, which illustrate the orientation device 126 in greater detail. Orientation device 126 includes two positions: a reorientation position, illustrated in FIGS. 2A, 2B, and 2C, and a guide position, to be explained more fully with reference to FIG. 3. In the reorientation position, a reorientation arrangement 201 is configured to sequentially receive mail items 202 from an upstream process via conveyor 124 and reorient each piece by turning it upside down. In the guide position, a guide arrangement 203 guides each mail item 202 onto the conveyor 128 without reorienting it. The device 126 is repositionable laterally with respect to the conveyor 124 along rails 204 between the reorientation and guide positions. A position sensor 205, such as a magnetic proximity sensor, senses which of the two positions the device 126 is in and electronically configures the device accordingly, as will be explained in more detail hereinafter.

The reorientation arrangement 201 includes a receiving arrangement 206. The receiving arrangement includes a sensor 208, such as a photoreflective sensor, that senses the presence of an incoming mail item 202. Brushes 209 assist to guide the mail item 202 into a bin 210 of the reorientation arrangement 201. The bin 210 may include two containers arranged generally symmetrical with respect to one another about an axle 212 that defines an axis about which the two containers rotate. In such cases, the containers are positioned back-to-back such that when one container is positioned to receive a mail item, the other is positioned to deposit a previous mail item onto the conveyor 128.

When the sensor 208 senses the presence of a mail item 202, it sends a signal to a programmable logic controller which resides in the motor controller, such as a Vexta SC8800 Stepper Controller (PLC, not shown in FIG. 2). After the passage of a predetermined period of time, the PLC, via a motor controller, causes a motor 214, such as a Vexta AS66 Series Stepper Motor, to rotate the axle 212 (and thus the bin 210) approximately 180° about the axis. The delay allows time for the mail item 202 to settle into the bin 210. Following rotation of the bin 210, the mail item 202 falls out of the bin and onto the conveyor 128 with is previous top side now facing down. This is illustrated in FIG. 2B, which, through a cutout in the bin 210, shows a reoriented item on the conveyor 128. The conveyor 128 then moves the item to the next process. If the bin 210 includes two containers, then the second container is positioned to receive the next mail item.

The movement of the conveyor 128 may be continuous or incremental. The movement of the conveyor 128 may be controlled such that the items "shingle" along the conveyor toward the down stream process as can be see in FIG. 2C. In some embodiments, the PLC that operates the reorientation arrangement 201 also controls the movement of the conveyor 128. In other embodiments, other sensors and controllers move the conveyor 128.

The reorientation arrangement also includes a safety cover 216 that prevents access to the reorientation arrangement during operation. A pair of cover sensors 218, such as magnetic proximity sensors, sense the position of the safety cover 216 and prevent the reorientation arrangement 201 from operating when the cover is open.

Figure 3:
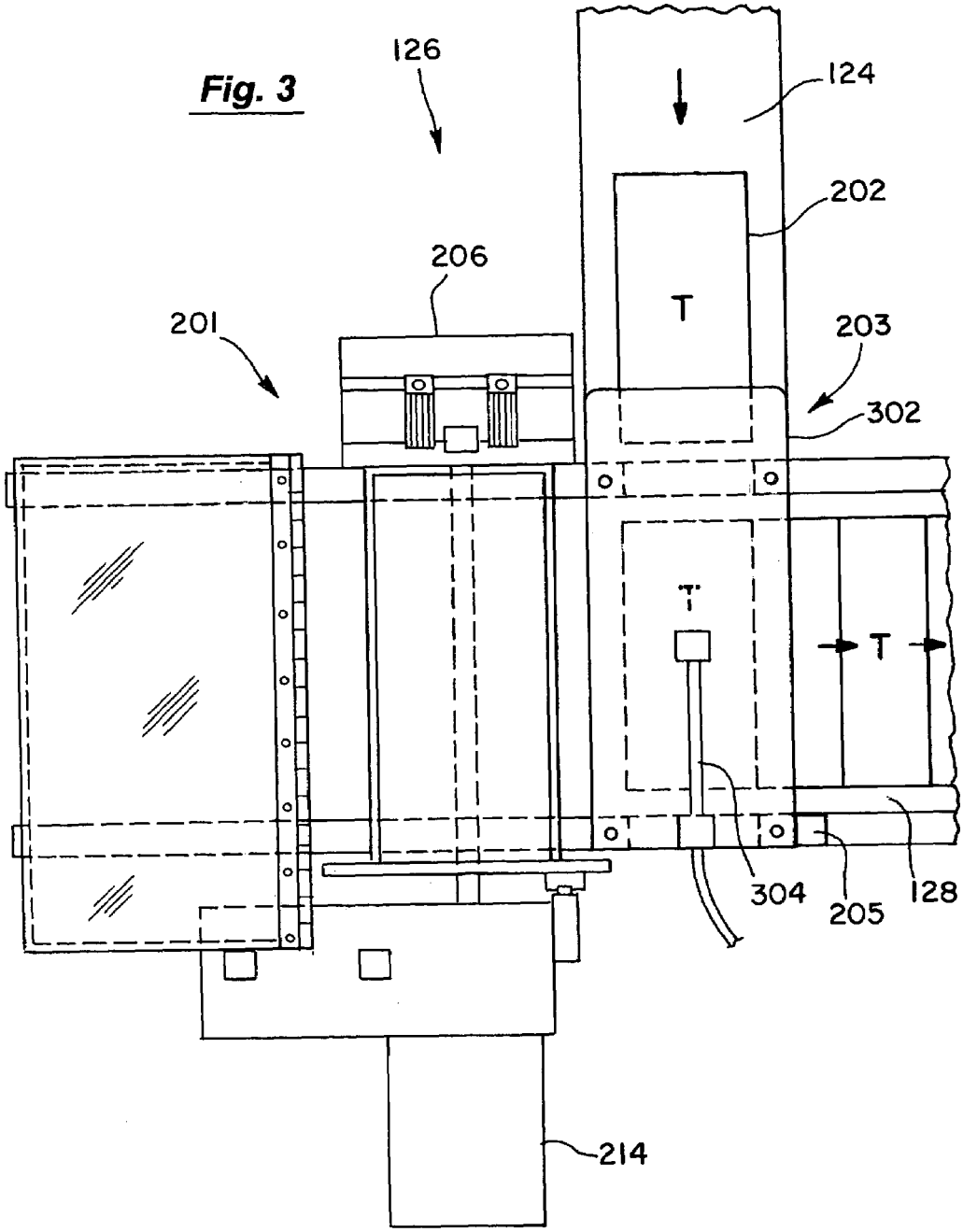
FIG. 3 illustrates the mail orientation device in a guide position according to embodiments of the invention.

Attention is directed to FIG. 3 which illustrates the orientation device 126 in the guide position. As mail items 202 enter the guide arrangement 203, a housing 302 guides each item to the conveyor 128. A sensor 304, such as a Sick WL160 Photoreflective sensor, senses the presence of a mail item on the conveyor 128. The conveyor 128 then moves the item toward the downstream process. The conveyor 128 may move the items incrementally, thus shingling the items, or continuously. If the items are moved incrementally, then the sensor 304 may be used to control the movement of the conveyor, causing the conveyor to be advanced only so far as is necessary to move the item outside the filed of view of the sensor.

Figure 4:
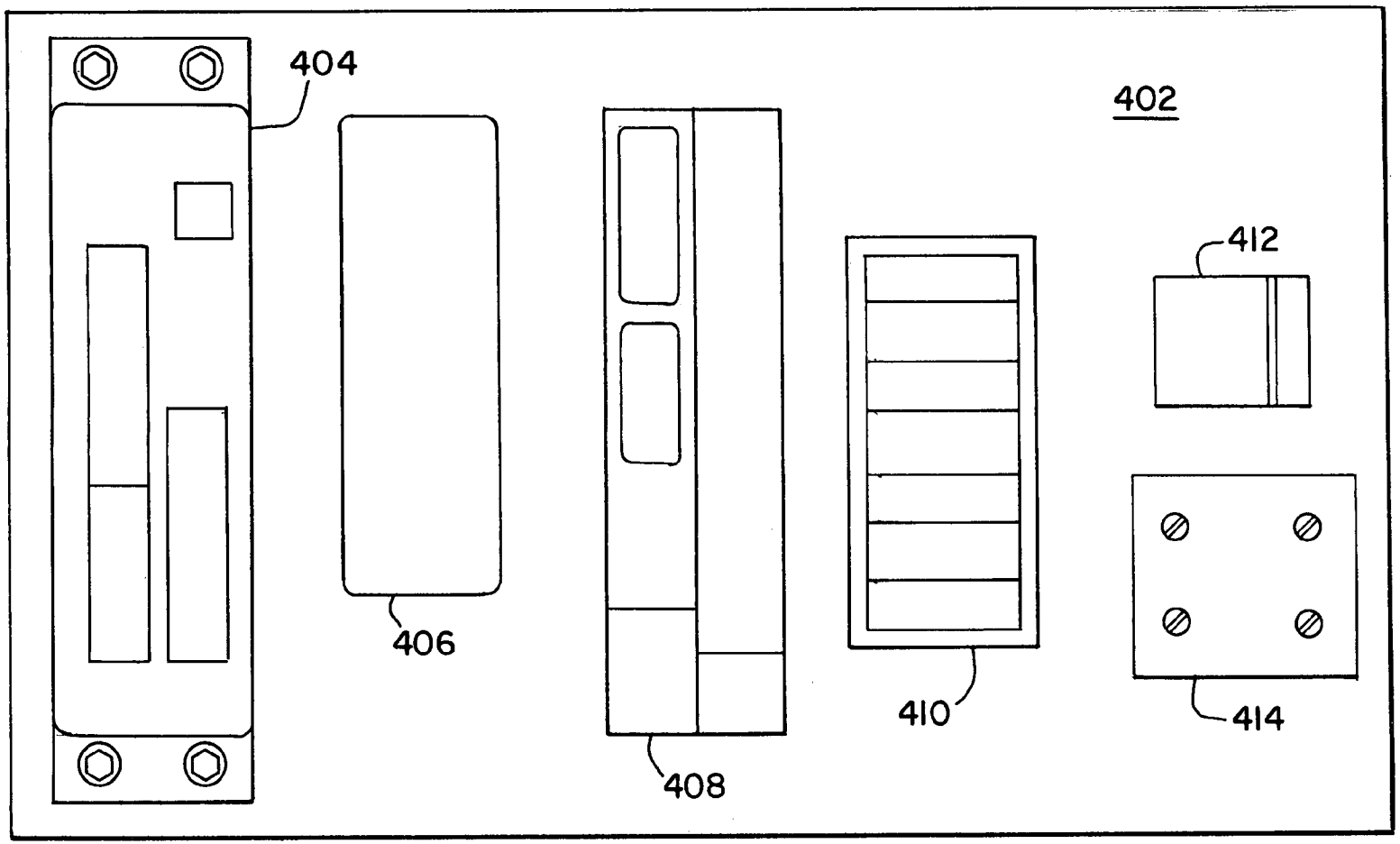
FIG. 4 illustrates a control unit for the orientation device.

Attention is directed to FIG. 4 which illustrates a control unit 402 of the orientation device 126. In this embodiment, the control unit includes a programmable logic controller within the motor control unit (PLC) 404, a Lamda 28v switcher power supply 406, a motor driver 408, a bus, or wire interface, 410, a Potter & Brumfield R10-E1-X4-115v mechanical relay 412 and a Crydom D1210 solid state relay 414. The control unit is shown without wires connecting the various components for ease of illustration. Those skilled in the art will appreciate how to interconnect the various components of the control unit 402 in light of this disclosure. Those skilled in the art also will realize that the control unit 402 illustrated here is but one example of a control unit that may be used with embodiments of the invention.

The PLC 404 receives signals from the various sensors and relays that indicate the operating condition of the orientation device 126. For example, when the device is in the reorientation position and the safety cover is closed, the PLC 404 allows operation of the reorientation arrangement 201. When the safety cover 216 is open or the device is in the guide position, then the PLC 404 prevents operation of the reorientation arrangement. The PLC 404 also controls the delay that allows an item to settle into the bin, signals the motor controller to advance the bin, and, in some embodiments, operates the conveyor 128. For example, in a specific embodiment, when the sensor 208 senses the presence of an incoming mail item 202, the PLC 404 initiates a delay of approximately 0.01 seconds. The PLC 404, then causes the bin 210 to rotate approximately 180° in about 0.35 seconds. The PLC 404 then causes the conveyor 128 to advance approximately 1.5 inches.

The power supply 406 provides power to the various components of the device. The motor controller 408 controls the positioning and movement of the bin. The bus 410 provides a central location for electrically connecting the components. The mechanical 412 and solid state 414 relays provide appropriate signals to the PLC 404 indicating the state of the device (e.g., safety cover open; device in guide position).

Having described several embodiments, it will be recognized by those of skill in the art that various modifications, alternative constructions, and equivalents may be used without departing from the spirit of the invention. Additionally, a number of well known processes and elements have not been described in order to avoid unnecessarily obscuring the present invention. Accordingly, the above description should not be taken as limiting the scope of the invention, which is defined in the following claims.

What is claimed is:

1. A mail processing device, comprising:

a reorientation arrangement that, when the mail processing device is in a first position, is configured to sequentially receive mail items from an upstream process and reorient each item such that the top side of a particular item from the upstream process becomes the bottom side of the item when placed in a downstream process;

a receiving arrangement configured to receive mail items from the upstream process and guide the mail items into the reorientation arrangement;

a controller that is programmed to cause the reorientation arrangement to reorient a mail item in response to the detection of the mail item by a sensor, wherein the controller is further programmed to cause the mail item to be moved toward the downstream process after each mail item is reoriented;

a guide arrangement that, when the mail processing device is in a second position, is configured to receive the mail items from the upstream process and guide each mail item to the down stream process without reorienting each item with respect to its top and bottom sides; and a sensor that senses whether the mail processing device is in the first position or the second position.

2. The mail processing device of claim 1, further comprising:

a guard having an open position and a closed position, wherein when the guard is in the closed position it generally restricts access to moving parts of the reorientation arrangement; and a sensor that senses the position of the guard and prevents operation of the reorientation arrangement when the guard is open and the mail processing device is in the first position.

3. The mail processing device of claim 1, wherein the mail items comprise a card carrier and a card attached thereto.

4. The mail processing device of claim 1, wherein the mail items comprise z-folded documents folded along two folds that divide the document into three roughly equal areas.

5. The mail processing device of claim 1, wherein the mail items comprise documents folded twice in half width-wise, along folds that divide the document into four roughly equal areas.

6. A mail processing device, comprising:

a reorientation arrangement that, when the mail processing device is in a first position, is configured to sequentially receive mail items from an upstream process and reorient each item such that the top side of a particular item from the upstream process becomes the bottom side of the item when placed in a downstream process;

a receiving arrangement configured to receive mail items from the upstream process and guide the mail items into the reorientation arrangement; and a controller that is programmed to cause the reorientation arrangement to reorient a mail item in response to the detection of the mail item by a sensor, wherein the controller is further programmed to cause the mail item to be moved toward the downstream process after each mail item is reoriented;

wherein the reorientation arrangement comprises:

a bin that receives each mail item;

an axle that defines an axis about which the bin is configured to rotate; and a motor configured to rotate the bin approximately 180° about the axis by driving the axle.

7. The mail processing device of claim 6, wherein the bin comprises a first container and a second container that are arranged generally symmetrical with respect to one another about the axle such that the first container is disposed above the second container when the first container is positioned to receive a mail item, and wherein the first container is disposed below the second container when the first container is positioned to deposit a mail item onto a conveyor configured to transport the mail item toward the downstream process, thereby positioning the second container to receive a subsequent mail item.

8. A mail processing device, comprising:

means for sequentially receiving mail items from an upstream process;

means for reorienting each item such that the top side of each item in the upstream process becomes the bottom side of the item in a downstream process; and means for sequentially advancing each mail item to the downstream process;

wherein the means for reorienting each item comprises:

a bin that receives each mail item;

an axle that defines an axis about which the bin is configured to rotate; and a motor configured to rotate the bin approximately 180° about the axis by driving the axle.

9. The mail processing device of claim 8, wherein the mail items comprise a card carrier and a card attached thereto.

10. The mail processing device of claim 8, wherein the mail items comprise z-folded documents such that two folds divide the document into three roughly equal areas.

11. The mail processing device of claim 8, wherein the mail items comprise documents folded twice in half width-wise, thus positioning folds that divide the document into four roughly equal areas.

12. The mail processing device of claim 8, further comprising means for guiding each mail item from the upstream process to the down stream process without reorienting each item with respect to its top and bottom sides.

* * * * *